US009394906B2

(12) United States Patent
Fujimoto et al.

(10) Patent No.: US 9,394,906 B2
(45) Date of Patent: Jul. 19, 2016

(54) OIL FREE SCREW COMPRESSOR

(75) Inventors: Hideki Fujimoto, Shizuoka (JP); Hitoshi Nishimura, Shizuoka (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 1761 days.

(21) Appl. No.: 12/166,347

(22) Filed: Jul. 2, 2008

(65) Prior Publication Data

US 2009/0016921 A1 Jan. 15, 2009

(30) Foreign Application Priority Data

Jul. 3, 2007 (JP) ..... 2007-175412

(51) Int. Cl.

| | |
|---|---|
| ***F04B 39/04*** | (2006.01) |
| ***F04C 18/16*** | (2006.01) |
| ***F04C 29/02*** | (2006.01) |
| ***F04C 29/04*** | (2006.01) |
| *F28D 21/00* | (2006.01) |

(52) U.S. Cl.

CPC ..... *F04C 18/16* (2013.01); *F04C 29/02* (2013.01); *F04C 29/04* (2013.01); *F28D 2021/0049* (2013.01)

(58) Field of Classification Search

CPC ..... F04C 18/16; F04C 29/02; F04C 29/04; F28D 2021/0049

USPC ..... 417/228, 243; 418/84, 85; 165/288, 165/291, 292, 293, 299, 300

See application file for complete search history.

(56) References Cited

U.S. PATENT DOCUMENTS

| | | | | |
|---|---|---|---|---|
| 4,803,848 | A | 2/1989 | LaBrecque | |
| 5,362,207 | A * | 11/1994 | Martin et al. | 417/243 |
| 5,718,563 | A * | 2/1998 | Hutchinson | 417/32 |
| 6,551,082 | B2 * | 4/2003 | Douzono et al. | 418/83 |
| 6,679,689 | B2 * | 1/2004 | Takahashi et al. | 418/9 |

(Continued)

FOREIGN PATENT DOCUMENTS

| | | |
|---|---|---|
| EP | 1 795 837 | 6/2007 |
| JP | 01-116297 | 5/1989 |

(Continued)

OTHER PUBLICATIONS

Nakamura Hajme, Oil-Cooled Compressor, Jul. 25, 2003, Japanese Patent Publication 2003-206864, Abstract.*

(Continued)

*Primary Examiner* — Charles Freay
(74) *Attorney, Agent, or Firm* — Baker Botts L.L.P.

(57) ABSTRACT

Provided is a highly reliable oil free screw compressor including a first sensor for detecting a temperature of lubrication oil, second sensors for detecting temperatures of intake air, and a cooling fan controller having a storage portion storing therein a set temperature of lubrication oil and a set temperature of intake air, and a computing portion for computing a control signal for increasing the speed of the cooling fan if a detected value of a temperature of the lubrication oil, delivered from the first sensor, becomes higher than the set value of lubrication oil stored in the storage portion, and computing a control signal for increasing the speed of the cooling fan if a detected value of a temperature of the intake air, delivered from the second sensor, becomes higher than the set temperature of the intake air, stored in the storage portion.

15 Claims, 4 Drawing Sheets

(56) References Cited

U.S. PATENT DOCUMENTS

| | | | | |
|---|---|---|---|---|
| 6,695,047 | B2 * | 2/2004 | Brocksopp | 165/292 |
| 7,708,538 | B2 * | 5/2010 | Kawabata et al. | 418/83 |
| 2007/0152552 | A1 * | 7/2007 | Shih et al. | 313/13 |
| 2008/0206085 | A1 * | 8/2008 | Zieglgansberger | 418/85 |
| 2010/0233004 | A1 * | 9/2010 | Matsuzaka et al. | 418/84 |

FOREIGN PATENT DOCUMENTS

| | | |
|---|---|---|
| JP | 06-213188 | 8/1994 |
| JP | 2000-260606 | 9/2000 |
| JP | 2003-206864 | 7/2003 |
| JP | 2006-249934 | 9/2006 |
| JP | 2006-316696 | 11/2006 |
| JP | 2007-146698 A | 6/2007 |

OTHER PUBLICATIONS

English Translation of JP 2003-206864 to Nakamura et al, Jul. 25, 2013.*

Partial translation Written Opinion dated Feb. 9, 2011.

Office Action of JP Appln. No. 2013-211660 dated Sep. 9, 2014 with English translation.

* cited by examiner

OIL FREE SCREW COMPRESSOR

INCORPORATION BY REFERENCE

The present application claims priority from Japanese application JP 2007-175412 filed on Jul. 3, 2007, the content of which is hereby incorporated by reference into this application.

BACKGROUND OF THE INVENTION

The present invention relates to an oil free screw compressor capable of controlling the speed of a cooling fan, and in particular to an oil free screw compressor capable of appropriately maintaining temperatures of compressed air and lubrication oil in response to variation in a surrounding atmosphere.

There has been known an air-cooled oil-free screw compressor for compressing air by a pair of male and female screw rotors which can be rotated in a noncontact and nonlubricated manner. The air-cooled oil-free screw compressor incorporates an air-cooling type cooler for cooling lubrication oil for lubricating bearings, gears and the like, and compressed air, having the configuration that the atmospheric air is taken thereinto by means of a fan in order to carry out heat-exchange with the lubrication oil and the compressed air (Refer to, for example, JP-A-01-116297).

BRIEF SUMMARY OF THE INVENTION

An air-cooled and oil free screw compressor has a compressor body in which a pair of male and female screw rotors are journalled by bearings and are rotated by a motor through the intermediary of gears. Further, the bearings and gears which are used in a drive portion, externally or internally of the compressor body are adapted to be fed thereto with lubrication oil.

The air-cooled and oil free screw compressor of this type is possibly installed in a place where the atmospheric temperature varies greatly in comparison with its predetermined specification. In this case, should the temperature of the lubrication oil become lower than an appropriate temperature, the viscosity of the lubrication oil would be increased, resulting in slight increase in mechanical power loss in the bearings and gears. Further, the temperature rise of the lubrication oil would cause shortening of the service life of the lubrication oil itself.

Further, even the temperature of the compressed air discharged from the compressor body varies depending upon the atmospheric temperature, a temperature rise of the compressed air caused by a temperature rise of the atmospheric air would shorten the service life of the air cooling type cooler, and further, should the temperature of the compressed air exceed a set temperature of a protection device for the compressor, the compressor would come to a stop for accident prevention. Further, should the atmospheric temperature be excessively lower than an appropriate temperature, resulting in generation and increase of condensed water in the compressed air, there would be caused reduction of the production volume of the compressed air and failures of equipments inside and outside of the compressor.

Further, in the air cooling type cooler for the lubrication oil and the compressed air, as stated above, the heat-exchange is carried out by cooling air which has been taken into the cooler from the outside of the compressed air, and accordingly, if the speed of the cooling fan is constant, there would be caused the problem that the temperatures of the lubrication oil and the compressed air vary depending upon an atmospheric temperature.

The present invention is devised in view of the above-mentioned circumstances, and accordingly, an object of the present invention is to provide a nonlubricated screw compressor capable of appropriately maintaining the temperatures of lubrication oil and intake air with a high degree of reliability even though the atmospheric temperature varies.

To the end, according to a first aspect of the present invention, there is provided an oil free screw compressor comprising a compressor body having a pair of male and female screw rotors which are rotatable in a noncontact and nonlubricated manner, an air-cooling type cooler for lubrication oil for the compressor, an air-cooling type cooler for compressed air, a cooling fan for feeding cooling air into the compressor body and the air-cooling type coolers and a cooling fan controller including a first sensor for detecting a temperature of the lubrication oil, a second sensor for detecting a temperature of intake air, a storage portion for storing a set temperature of the lubrication oil and a set temperature of the intake air, and a computing portion for computing a control signal adapted to increase the speed of the cooling fan if a detected value of a temperature of the lubrication oil, delivered from the first sensor, exceeds the set temperature of the lubrication oil stored in the storage portion, and also computing a control signal for increasing the speed of the cooling fan if a detected value of a temperature of the intake air, delivered from the second sensor, exceeds the set temperature of the intake air stored in the storage portion.

Further, a second aspect of the present invention, in the first aspect of the invention, is characterized in that the speed of the cooling fan is controlled by an inverter exclusively used for the cooling fan.

Further, a third aspect of the present invention, in the first aspect of the present invention, is characterized in that the speed of the cooling fan is controlled by an inverter for the compressor.

Further a fourth aspect of the present invention, in the first aspect of the present invention, is characterized in that the cooling fan controller takes thereinto temperatures inside and outside of the compressor so as to control the speed of the cooling fan.

Further, a fifth aspect of the present invention, in the first aspect of the present invention, is characterized in that the cooling fan controller takes thereinto a temperature in a control panel such as a starter panel so as to control the speed of the cooling fan.

According to the present invention, even though the atmospheric temperature varies, the temperatures of the lubrication oil and the intake air can be appropriately maintained, thereby it is possible to provide an oil free screw compressor with a high degree of reliability.

Other objects, features and advantages of the invention will become apparent from the following description of the embodiments of the invention taken in conjunction with the accompanying drawings.

DETAILED DESCRIPTION OF THE INVENTION

Next, explanation will be hereinbelow made of embodiments of the oil free screw compressor according the present invention with reference to the accompanying drawings.

Explanation will be hereinbelow made of an oil free screw compressor in an embodiment of the present invention, comprising a compressor body having a pair of male and female screw rotors which can be rotated by a timing gear in a noncontact and nonlubricated manner, an air-cooling type cooler for cooling compressed air discharged from the compressor body, an air-cooling type cooler for cooling lubrication oil for bearings and gears in drive portions inside and outside of the compressor body, and a cooling fan the speed of which can be controlled so as to adjust volumes of cooling air fed into these coolers.

Specifically, there are provided an inverter exclusively used for the cooling fan, and a controller therefor, and any one of a temperature of lubrication oil, a temperature of intake air, temperatures inside and outside of the compressor unit, a temperature in a starter panel, is detected by a temperature sensor in order to control the speed of the cooling fan. Further, the speed of the cooling fan can be controlled in synchronization with the capacity control of the compressor.

Figure 1:
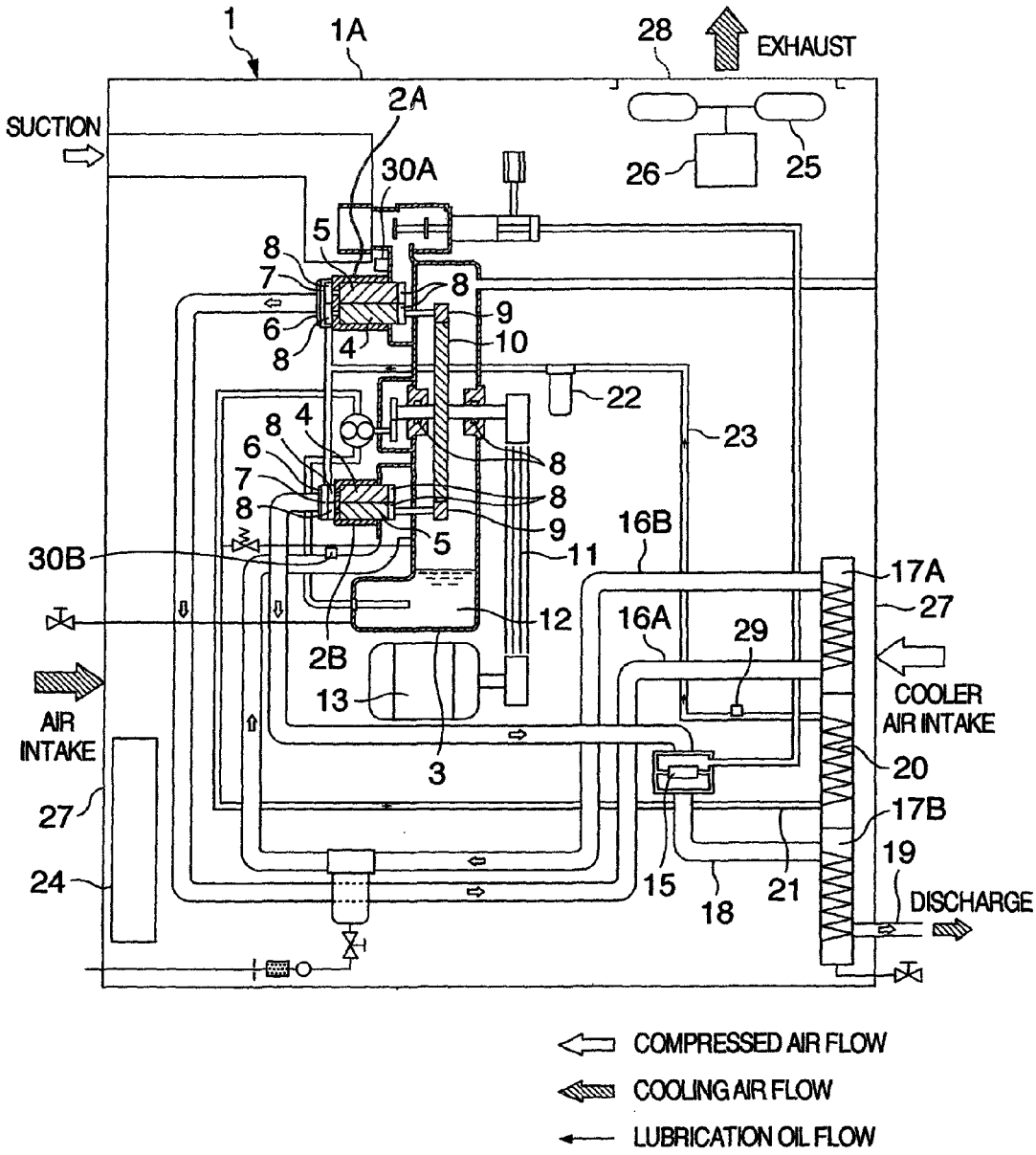
FIG. 1 is a systematic view illustrating an overall configuration of a two-stage air-cooled and oil free screw compressor in an embodiment of the present invention.

Referring to FIG. 1 which is a systematic view illustrating an overall configuration of a two stage air-cooled and oil free screw compressor in an embodiment of the present invention, the oil free screw compressor 1 comprises, in its housing 1A, a first stage compressor body 2A and a second stage compressor body 2B which are provided in a gear casing 3, and each of which is incorporated therein with a pair of screw rotors, that is, a male rotor 4 and a female rotor 5 which are attached thereto with timing gears 6, 7 in one axial end portion thereof.

A pinion gear 9 is attached to the male rotor 5 at one axial end thereof. This pinion gear 9 is meshed with a bull gear 10 which is coupled with a drive shaft. The pinion gear 9 and the bull gear 10 are accommodated in the gear casing 3. The gear casing 3 defines in its lower part with an oil sump 12. Further, the rotors and the drive shaft are supported by bearings 8, respectively. A pulley attached to one part of the drive shaft having the bull gear 10 and a sheave attached to one axial end part of a motor shaft are wound thereon and therebetween with a drive belt 11. An output power is transmitted from a motor 13 to the compressor bodies 2A, 2B through the intermediary of the compressor drive gears 10 and the belt 11.

As to the flow of the compressed air, the atmospheric air which has been taken into the compressor unit is compressed by the single stage compressor body 2A, then passing through a discharge pipe line 16A and being cooled by an air cooler 17A for the first stage compressor body, and flows through a discharge pipe line 16B. Thereafter it is compressed by the second stage compressor body 2B. The air compressed by the second stage compressor body 2B flows through a discharge pipe line 18, then being cooled by the cooler 17B for the second stage compressor and then passing through a discharge pipe line 19, and is fed into a pipe line connected to an equipment outside of the compressor unit. The discharge pipe line 18 is connected therein with a check valve 15.

As to the flow of the lubrication oil, the lubrication oil reserved in the oil sump 12 in the gear casing 3 flows through a lubrication pipe line 21, being cooled by a cooler 20 for the lubrication oil and then passing through the oil filter 22 which is connected in a lubrication oil pipe line 23, and is thereafter fed into the bearings 8 and gears 9, 10 in the drive portion including the first stage compressor body 2*a* and the second stage compressor body 2B.

The compressor 1 incorporates a starter and control panel 24 in its housing 1A (refer to the left lower side in FIG. 1). Further, the compressor 1 also incorporates a cooling fan 25 in its housing 1A (refer to the right upper side in FIG. 1). The speed of the cooling fan 25 is controlled by a motor 26. When the cooling fan 25 is rotated, the atmospheric air is taken into the housing 1A through an intake port 27 formed in the housing 1A. This atmospheric air is heat-exchanged through the compressed air coolers 17A, 17B and the lubrication oil cooler 20 after it cools the interior of the unit, and is thereafter discharged from the housing 1A through an exhaust port 28 formed in the housing 1A.

The pipe line 23 is connected therein with a first sensor 29 for detecting a temperature of the lubrication oil, on the outlet side of the lubrication oil cooler 20, and second sensors 30A, 30B for detecting temperatures of the intake air are provided on the suction sides of the first stage compressor body 2A and the second stage compressor body 2B. Detection signals from the sensors 29, 30A, 30B are delivered to a cooling fan controller 31 which will be detailed later.

Figure 2:
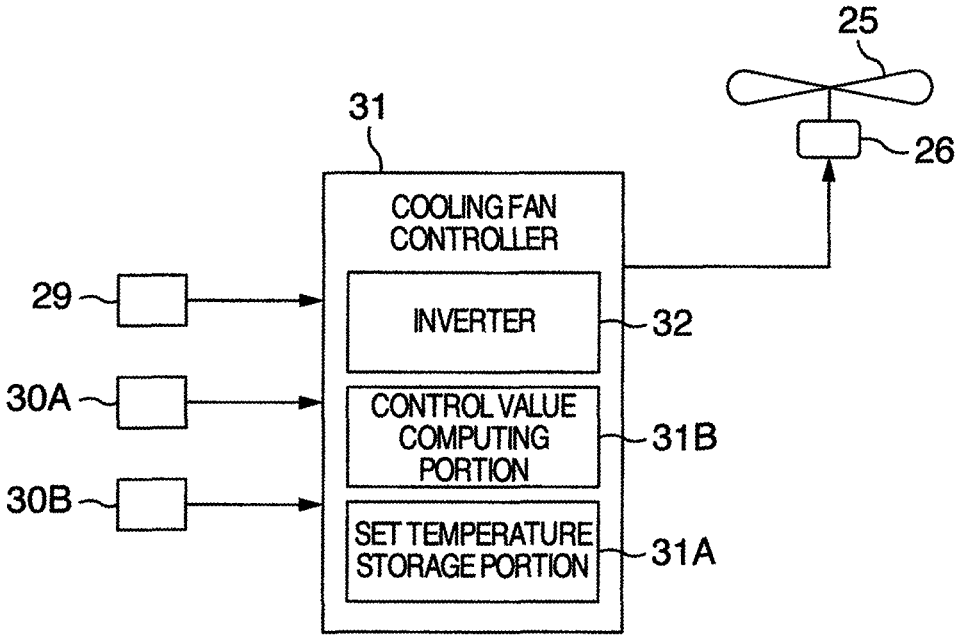
FIG. 2 is a view illustrating a configuration of a cooling fan controller constituting the two-stage air-cooled and oil free screw compressor in an embodiment of the present invention.

Referring to FIG. 2 which shows a configuration of cooling fan controller 31 that constitutes the two stage air-cooled and oil free screw compressor in the embodiment of the present invention, in which like reference numerals are used to denote like parts to those shown in FIG. 1 in order to abbreviate detailed explanation thereto.

The cooling fan controller 31 incorporates a storage portion 31A storing therein a set temperature of lubrication oil and a set temperature of intake air, and a computing portion 31B for computing a control signal for increasing the speed of the cooling fan 25 if a detected value of a lubrication oil temperature, delivered from the first sensor 29, becomes higher than the set temperature of lubrication oil stored in the storage portion 31A, and also computes a-control signal for increasing the speed of the cooling fan 25 if detected values of intake air temperatures, delivered from the second sensors 30A, 30B become higher than the set temperature of intake air stored in the storage portion 31A. The control signals from the computing portion 31B are delivered to the inverter 32 exclusively used for the cooling fan. An output power from the inverter 32 is accordingly delivered to the motor 26 for the cooling fan 25 the speed of which is therefore controlled by the motor 26.

Next, explanation will be made of operation the two stage air-cooled and nonlubricated compressor in the present invention with reference to FIGS. 1 and 2.

The temperature of the lubrication oil is delivered from the first sensor 29 while the temperatures of the intake air are delivered from the second sensors 30A, 30B, and these temperature are then received by the computing part 31B of the cooling fan controller 31. Due to influence of the surrounding atmosphere in view of, for example, a place where the oil free screw compressor 1 is installed, when the temperature of the lubrication oil is increased so as to become higher than the set temperature of the lubrication oil stored in the storage portion 31A, the computing portion 31B of the cooling fan controller 31 delivers a control signal to the motor 26 for the cooling fan 25 through the intermediary of the inverter 32 exclusively used for the cooling fan 25 in order to increase the speed of the cooling fan 25. Thus, the speed of the cooling fan 25 is increased so as to increase the volume of the cooling air, and accordingly, the temperature rise of the lubrication oil is restrained, thereby it is possible to maintain the lubrication oil at an appropriate temperature.

Further, due to the influence of the surrounding atmosphere in the place where the oil free screw compressor 1 is installed and so forth, when the temperature of intake air is increased up to a value which is higher than the set temperature of intake air stored in the storage portion 31A, the computing portion 31B of the cooling fan controller 31 delivers a control signal to the motor 26 of the cooling fan 25 through the intermediary of the inverter exclusively used for the cooling fan 25 so as to increase the speed of the cooling fan 25. Thus, the speed of the cooling fan 25 is increased, and accordingly, the volume of the cooling air is increased so as to suppress the temperature rise of the intake air, thereby it is possible to maintain the intake air at an appropriate temperature.

It is noted in this embodiment that the control of the cooling fan in response to a temperature rise of the lubrication oil and the control of the cooling fan in response to a temperature rise of the intake air are made in preference of either one of the set values. Alternately, the computing portion 31B controls the temperatures of both lubrication oil and intake air so as to maintain the temperatures within predetermined temperature ranges.

As stated above, in this embodiment, the temperature of the lubrication oil can be appropriately maintained even though the atmospheric temperature varies, and the temperature of the compressed air can be appropriately maintained by appropriately maintaining the temperature of the intake air, thereby it is possible to maintain the oil free screw compressor with a high degree of reliability.

Figure 3:
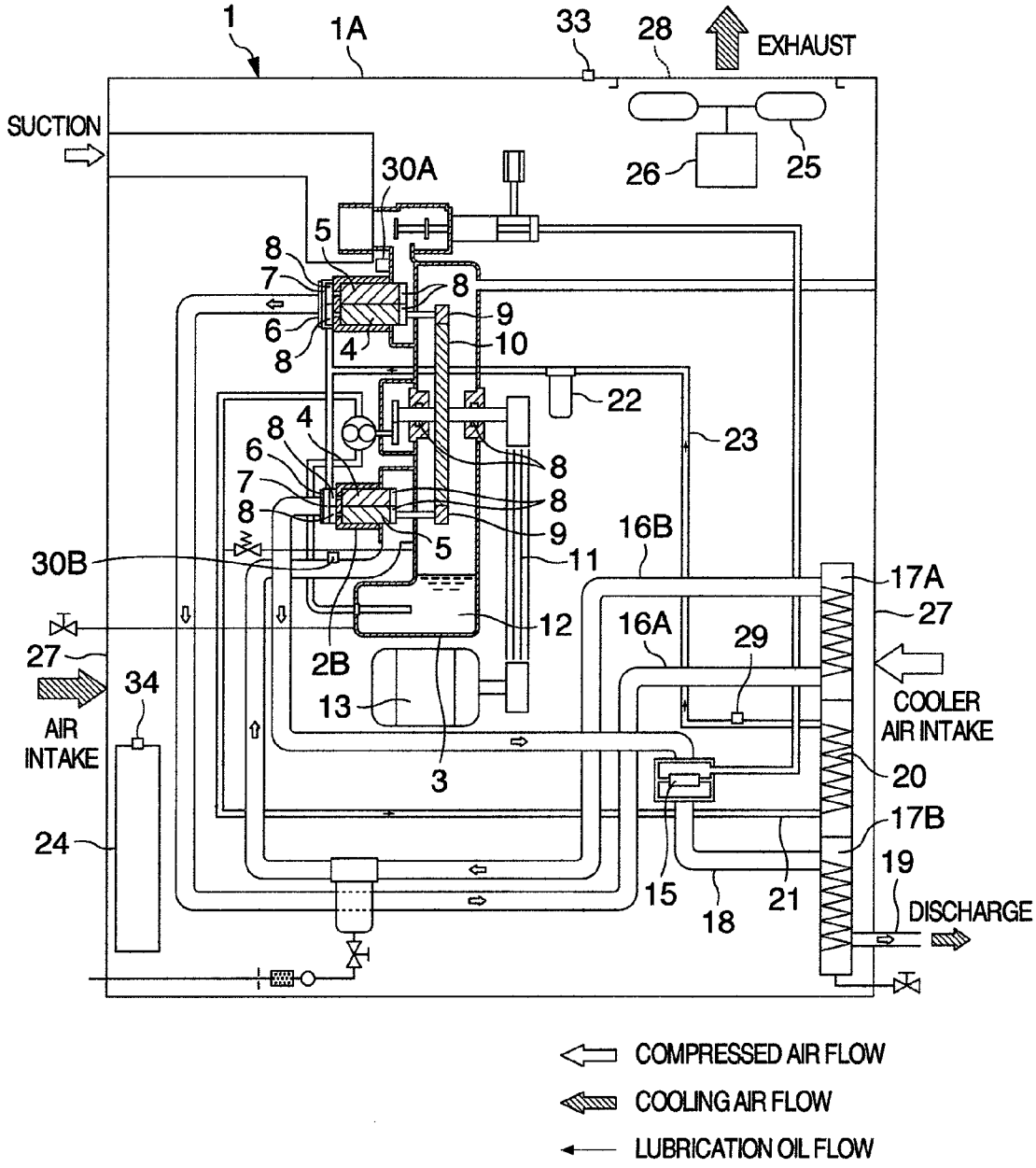
FIG. 3 is a systematic view illustrating a two-stage screw air-cooled and nonlubricated compressor in another embodiment of the present invention.
Figure 4:
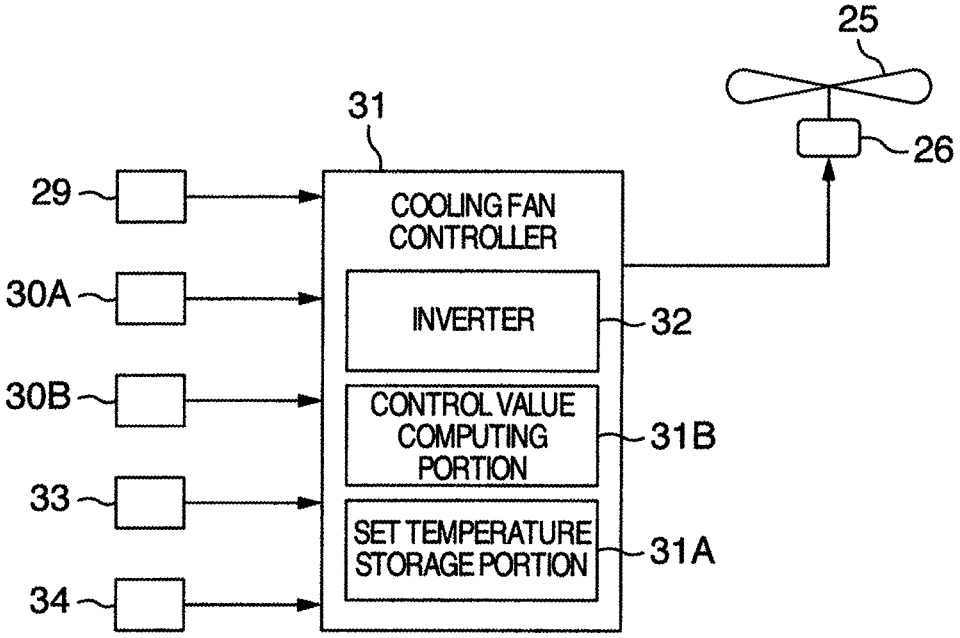
FIG. 4 is a view for a cooling fan controller constituting the two-stage screw air-cooled and nonlubricated compressor according to the present invention, shown in FIG. 3.

Referring to FIGS. 3 and 4 which show a two stage air-cooled and oil free screw compressor in another embodiment of the present invention, in which FIG. 3 is a systematic view illustrating the overall configuration of the compressor and FIG. 4 is a view illustrating a cooling fan controller for the compressor, and in which like reference numerals are used to denote like parts to those shown in FIGS. 1 and 3, in order to abbreviate the detailed explanation thereto.

In this embodiment, in addition to the control of the cooling fan in response to a temperature rise of the lubrication oil and the control of the cooling fan in response to a temperature rise of the intake air as stated in the afore-mentioned embodiment, there are provided a third sensor 33 for detecting temperatures inside and outside of the housing 1A and a fourth sensor 34 for detecting a temperature in the starter and control panel 24, in the housing 1A in order to control temperature rises inside and outside of the compressor unit and a temperature rise in the starter and control panel 24, and detection signals from these sensors 33, 34 are delivered to the cooling fan controller 31. Thus, the cooling fan controller 31 increases the speed of the cooling fan 25 when the detected values exceed set values, similar to the afore-mentioned embodiment, in order to appropriately maintain the temperatures outside and inside of the compressor unit and the temperature in the starter and control panel 24. Thereby it is possible to reduce a thermal load with respect to the motors and equipments in the starter panel.

Further, by synchronizing the capacity control of the discharged compressed air with the speed control of the cooling fan in the loader shown in FIG. 1, a compressor with an automatic stop function or an inverter controlled compressor, the temperature of lubrication oil, the temperature of discharged compressed air, the temperature in the compressor unit and the temperature in the starter and control panel can be maintained appropriately. In this case, there may be provided the configuration that the cooling fan 25 is rotated at a lowest frequency of the inverter or is stopped after confirmation of a temperature in the unit upon stopping of the compressor under the capacity control.

Further, in the above-mentioned embodiment, although the speed of the cooling fan 25 is controlled by the inverter 32 exclusively used for the cooling fan 25, the speed of the cooling fan 25 can be controlled by an inverter for the compressor.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An oil free screw compressor comprising:

a compressor housing;

at least one compressor body having a pair of male and female screw rotors which are rotatable in a noncontact and nonlubricated manner provided in the compressor housing, a gear casing provided in the compressor housing and which defines in its lower part an oil sump and which accommodates a first gear which is attached to one of the pair of male and female screw rotors at one axial end thereof and a second gear which is coupled with a drive shaft and meshed with the first gear, a first motor for providing power for driving the at least one compressor body through the drive shaft, the second gear and the first gear, a compressed air discharge line provided in the compressor housing for discharging compressed air from the at least one compressor body, a lubrication oil pipe line provided in the compressor housing separately from the compressed air discharge line for flowing lubrication oil from the oil sump to at least the first and second gears, an air cooling cooler for cooling lubrication oil for the compressor flowing in the lubrication oil pipe line, an air cooling cooler for cooling compressed air flowing in the compressed air discharge line, a cooling fan for feeding cooling air into the compressor housing and the air cooling coolers, a second motor for driving the cooling fan, a first sensor for detecting a temperature of lubrication oil, a second sensor for detecting a temperature of intake air, a cooling fan controller including a storage portion storing therein a set temperature of the lubrication oil and a set temperature of the intake air, and a computing portion configured to compute a control signal for controlling a power delivered to the second motor for increasing the speed of the cooling fan if a detected value of a temperature of the lubrication oil, delivered from the first sensor, becomes higher than the set temperature of the lubrication oil stored in the storage portion, and configured to compute a control signal for controlling a power delivered to the second motor for increasing the speed of the cooling fan if a detected value of a temperature of the intake air, delivered from the second sensor, becomes higher than the set temperature of the intake air.

2. An oil free screw compressor as set forth in claim 1, characterized in that the power delivered to the second motor for increasing the speed of the cooling fan is controlled by an inverter exclusively used for the cooling fan.

3. An oil free screw compressor as set forth in claim 1, characterized in that the power delivered to the second motor for increasing the speed of the cooling fan is controlled by an inverter for the compressor.

4. An oil free screw compressor as set forth in claim 1, characterized in that the cooling fan controller receives temperatures inside and outside of the compressor unit so as to control the speed of the cooling fan.

5. An oil free screw compressor as set forth in claim 1, characterized in that the cooling fan controller receives a temperature in a control panel so as to control the speed of the cooling fan.

6. An oil free screw compressor as set forth in claim 5, characterized in that the control panel is a starter panel.

7. An oil free screw compressor as set forth in claim 1, characterized in that the pair of male and female screw rotors are supported at at least one end by bearings, and the bearings are lubricated by lubricating oil flowing in the lubrication oil pipe line.

8. An oil free screw compressor as set forth in claim 1, further comprising a first timing gear attached to the male screw rotor at another axial end thereof opposite the one axial end at which the first gear is attached to one of the pair of male and female screw rotors, and a second timing gear meshed with the first timing gear attached to the female screw rotor at the another axial end thereof.

9. An oil free screw compressor as set forth in claim 1, characterized in that the oil free screw compressor comprises at least two compressor bodies, each having a pair of male and female screw rotors which are rotatable in a noncontact and nonlubricated manner provided in the compressor housing.

10. An oil free screw compressor as set forth in claim 9, characterized in that the oil free screw compressor comprises at least a first stage compressor body and a second stage compressor body, each having a pair of male and female screw rotors which are rotatable in a noncontact and nonlubricated manner provided in the compressor housing, and the compressed air discharge line provided in the compressor housing comprises a first portion for discharging compressed air from the first stage compressor body and delivering the compressed air to the second stage compressor body and second portion for discharging compressed air from the second stage compressor body and delivering the compressed air outside the compressor housing.

11. An oil free screw compressor as set forth in claim 10, characterized in that the air cooling cooler comprises a first cooler for cooling compressed air flowing in the first portion of the compressed air discharge line and a second cooler for cooling compressed air flowing in the second portion of the compressed air discharge line.

12. An oil free screw compressor as set forth in claim 11, characterized in that the first sensor for detecting a temperature of lubrication oil is provided in a position for detecting a temperature of lubrication oil in the lubrication oil pipeline downstream of the air cooling cooler for cooling lubrication oil.

13. An oil free screw compressor as set forth in claim 12, characterized in that the second sensor comprises a plurality of sensors, a first one of the plurality of sensors being provided in a position for detecting a temperature of intake air on a suction side of the first stage compressor body, and a second one of the plurality of sensors being provided in a position for detecting a temperature compressed air flowing in the first portion of the compressed air discharge line.

14. An oil free screw compressor as set forth in claim 13, characterized in that the compressed air discharge line discharges compressed air directly from the pair of male and female screw rotors of the at least one compressor body, and the compressed air discharged through the compressed air discharge line does not pass through the gear casing or the oil sump.

15. An oil free screw compressor as set forth in claim 1, characterized in that the compressed air discharge line discharges compressed air directly from the pair of male and female screw rotors of the at least one compressor body, and the compressed air discharged through the compressed air discharge line does not pass through the gear casing or the oil sump.

* * * * *